United States Patent [19]

Wingfield, Jr. et al.

[11] Patent Number: 4,458,095

[45] Date of Patent: Jul. 3, 1984

[54] USE OF ZINC AND COPPER (I) SALTS TO REDUCE SULFUR AND NITROGEN IMPURITIES DURING THE PYROLYSIS OF PLASTIC AND RUBBER WASTE TO HYDROCARBONS

[75] Inventors: Robert C. Wingfield, Jr.; Jacob Braslaw, both of Southfield; Roy L. Gealer, West Bloomfield, Mich.

[73] Assignee: Ford Motor Company, Dearborn, Mich.

[21] Appl. No.: 429,369

[22] Filed: Sep. 30, 1982

[51] Int. Cl.[3] ..... C07C 7/00; C07C 7/16

[52] U.S. Cl. ..... 585/241; 585/845; 585/849; 585/848; 202/246; 202/247; 202/254

[58] Field of Search ..... 585/241, 240, 832, 833, 585/845, 848, 849; 208/246, 247, 254 R

[56] References Cited

U.S. PATENT DOCUMENTS

| | | | |
|---|---|---|---|
| 2,276,526 | 3/1942 | Von Fuchs et al. | 208/247 |
| 2,640,010 | 5/1953 | Hoover | 208/246 |
| 3,193,496 | 7/1965 | Harling | 208/247 |
| 4,113,606 | 9/1978 | Mulaskey | 208/246 |
| 4,204,947 | 5/1980 | Jacobson et al. | 208/246 |

FOREIGN PATENT DOCUMENTS

| | | | |
|---|---|---|---|
| 250951 | 5/1963 | Australia | 208/246 |
| 537244 | 2/1957 | Canada | 208/246 |
| 2925620 | 1/1981 | Fed. Rep. of Germany . | |
| 2944989 | 5/1981 | Fed. Rep. of Germany . | |
| 632724 | 7/1977 | U.S.S.R. | 208/247 |
| 721460 | 11/1977 | U.S.S.R. | 208/247 |

OTHER PUBLICATIONS

Processing of Plastic Waste and Scrap Tires into Chemical Raw Materials, Especially by Pyrolysis, Sinn, H., Kaminsky, W., Janning, J., Angnew Chem. Int. Ed. Engl./vol. 15 (1976), No. 11, 660–672.

Pyrolytic Recovery of Raw Materials from Special Wastes, Collin, G., 1980 ACS. pp. 479–484.

Pyrolytisch Rohstoff-Ruckgewinnung aus unterschiedlichen Sonder abfallen in einem Drehtrommelreaktor, Collin, G., Grigoleit, G., Michel, E., Chem.-Ing. Tech. 51 (1979) Nr. 3, S. 220–224.

*Primary Examiner*—Delbert E. Gantz
*Assistant Examiner*—A. Pal
*Attorney, Agent, or Firm*—Lorraine S. Melotik; Roger L. May

[57] ABSTRACT

An improvement in a process for the pyrolytic conversion of rubber and plastic waste to hydrocarbon products which results in reduced levels of nitrogen and sulfur impurities in these products. The improvement comprises pyrolyzing the waste in the presence of at least about 1 weight percent of salts, based on the weight of the waste, preferably chloride or carbonate salts, of zinc or copper (I).

10 Claims, 1 Drawing Figure

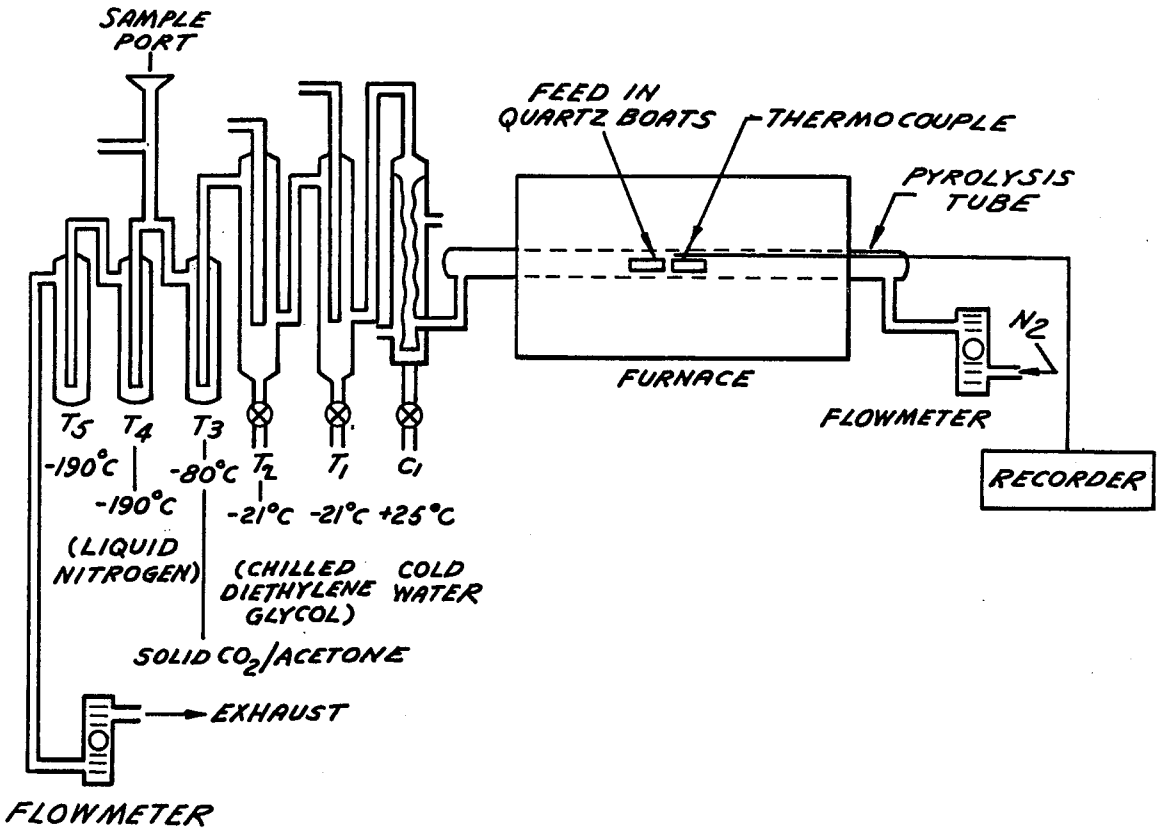
RECORDER
$N_2$
FLOWMETER
PYROLYSIS TUBE
THERMOCOUPLE
FEED IN QUARTZ BOATS
FURNACE
C1
T1
T2
T3
T4
T5
SAMPLE PORT
-21°C +25°C
-21°C
-80°C
-190°C
-190°C
(CHILLED DIETHYLENE GLYCOL)
COLD WATER
SOLID $CO_2$/ACETONE
(LIQUID NITROGEN)
EXHAUST
FLOWMETER

USE OF ZINC AND COPPER (I) SALTS TO REDUCE SULFUR AND NITROGEN IMPURITIES DURING THE PYROLYSIS OF PLASTIC AND RUBBER WASTE TO HYDROCARBONS

This invention was made under contract with or subcontract thereunder of the Department of Energy Contract #DE-AC02-78-ER10049.

TECHNICAL FIELD

This invention relates to an improvement in a process for the pyrolytic conversion of waste selected from rubber and plastic to hydrocarbon products, which improvement results in reduced levels of nitrogen and sulfur impurities in the hydrocarbon products. More particularly, the process improvement comprises pyrolyzing the waste in the presence of at least about 1 weight percent, based on the weight of the waste, of zinc or copper (I) salts.

BACKGROUND ART

When scrapped automobiles are shredded to recover ferrous and non-ferrous metals, large quantities of non-metallic solid waste are generated consisting mainly of rubber and plastic materials. The disposal of this material presently requires the use of valuable land-fill sites and constitutes the waste of potentially valuable resources. Pyrolysis, i.e., thermal decomposition in the absence of oxygen, of these mainly organic wastes into char and gaseous and liquid chemicals is one approach to an ecologically responsible as well as a profitable means of recycling both energy and chemical materials.

Pyrolyzed shredder waste has been shown to yield substantial amounts of highly aromatic pyrolysis oil from which chemical materials such as benzene, toluene and xylene can be produced. Generally, however, the liquid products produced from this pyrolytic conversion are used as fuels oils, i.e., for their energy content. The gaseous products produced by such processes are often simply combusted prior to release into the atmosphere. Advantageously, these gases have been burnt to generate heat for the pyrolytic process.

However, these oil and gaseous products generally contain undesirable conversion materials, which need to be removed in order to make these products suitable for use as described above. Attempts made to clean up these products generally comprise the addition of reactive materials to either the unpyrolyzed waste or to the volatile product to tie up these impurities. Alternately, the volatile pyrolysis products may be passed through a scrubbing (washing) tower in order to remove impurities. Elemental analysis of such pyrolysis oil reveals that it contains a significant amount of sulfur which reduces its value and usefulness in fuel applications and a higher level of nitrogen than found in diesel fuel.

In German Pat. No. 2,944,989 it is taught that by adding finely pulverized iron oxide to the volatile pyrolysis product, the sulfur pollutant is reduced.

DISCLOSURE OF THE INVENTION

This invention provides an improvement in a process for the pyrolytic conversion of rubber and plastic waste to hydrocarbon products which improvement results in reduced levels of nitrogen and sulfur impurities in these products. The improvement comprises pyrolyzing the waste in the presence of at least about 1 weight percent, based on the weight of the waste, of zinc or copper (I) salts. Preferably, these salts are chloride or carbonate salts of zinc or copper (I).

The salts may be admixed with the waste prior to and/or during pyrolisis of the waste.

Advantageously this invention substantially increases the suitability of such pyrolysis products for fuel applications. We have found that the total sulfur content of the liquid and gaseous products can be reduced at least about 40% and that the total nitrogen content of the liquid products can be reduced at least about 50% when employing the improvement of this invention.

Another process advantage of this invention is that the impurities are removed in the course of the pyrolytic decomposition, thus significantly eliminating the necessity for separate or subsequent clean up of the hydrocarbon products which would generally require additional process operations and equipment.

Advantageously, removal of these impurities during decomposition reduces the danger of corrosion to installation components that come into contact with the pyrolysis products. Additionally, such removal reduces the opportunity for undesirable product reactions which might result from the presence of these impurities in the vaporized products at elevated temperatures.

DESCRIPTION OF THE DRAWING

The FIGURE illustrates a typical laboratory system which may be used to pyrolyze rubber and plastic waste according to the process of the invention and subsequently recover the hydrocarbon gaseous and oil products.

BEST MODE FOR CARRYING OUT THE INVENTION

The automobiles being manufactured today contain a number of plstic and rubber components of varied composition. Typically, rubber and polyurethanes constitute the largest fraction, followed by glass reinforced polyester and polypropylene, as can be seen from Table I. Therefore, the shredding of the automobile will yield a very complex polymeric mixture. The shredder waste, in addition to the rubber and plastic materials, also contains a low level of metal resulting from the incomplete removal of metal and metal embedded in the rubber and plastic.

TABLE I

PLASTICS AND RUBBER IN 1979-1981 AUTOMOBILES*

| Component | Percent of Total |
|---|---|
| Non-Tire Rubber | 34.0 |
| Polyurethane | 14.8 |
| Reinforced Polyester | 14.2 |
| Polypropylene | 12.7 |
| Polyvinyl Chloride | 9.9 |
| ABS | 5.1 |
| Nylon | 2.4 |
| Acrylics | 1.6 |
| Phenolics | 1.6 |
| Other | 3.7 |

*Sources:
MODERN PLASTICS; January ANNUAL REVIEWS (1979-81)
ELASTOMERICS; January ANNUAL REVIEWS (1979-81)

In the process of this invention, the feed material is reduced to a particle size suitable for introduction into the pyrolysis zone. Consideration should be given to selecting that particle size which would give optimal surface contact with the added salts during pyrolysis, so as to have maximum efficiency of the improvement of this process.

The waste and the salts are then introduced into the pyrolysis zone, which may be preheated, and heated in the pyrolysis zone, generally to a temperature of between about 400° C. and 700° C., more preferably between about 450° C. and 650° C., most preferably between about 550° C. and 650° C., with a continuous inert gas sweep. Any inert, i.e., nonoxidizing gas may be employed in this process, e.g., helium, carbon dioxide, and mixtures thereof. A mixture of nitrogen and carbon dioxide, for example, can be obtained by burning a fuel gas mixture with a stoichiometric amount of air. The temperature of the pyrolysis zone and the flowing inert gas are maintained for a time sufficient to pyrolyze the waste to char and volatile hydrocarbon containing products. The hydrocarbon vapors generated are cooled to separate the products into a gas fraction and oil fractions, which are subsequently recovered.

The quartz tube batch pyrolysis apparatus shown in the FIGURE exemplifies one system for carrying out the improved process taught herein. In one particular embodiment of this system, the quartz tube has a two inch diameter and surrounding a portion of the quartz tube is a single zone tube furnace which gives a heated zone of about 36 inches. For processing in this system, the waste is ground to a particle size of about 2mm diameter, mixed with the salts, placed in a quartz boat and subsequently introduced into the pyrolysis zone. In this embodiment, nitrogen is employed as the inert gas with flow rates of 100cc–400cc/minute being suitable. The volatile hydrocarbon-containing products generated by the pyrolysis are condensed in a series of traps and recovered.

A continuously fed rotary kiln system can also be employed to carry out the process of the subject invention. The use of a rotary kiln advantageously offers mixing of the waste/salt mixture as well as continuos contact with the heated walls of the kiln. Additionally, a rotary kiln process more easily allows for continuous and rapid processing. A condensation train is attached at the discharge end of the rotary kiln for trapping the liquid condensate and sampling the gaseous product. In this system, the salts can be added to the waste before and/or during the pyrolysis of the waste. The particle size of the waste introduced into the rotary kiln is generally larger than that, for example, of a batch process, however particle size of the waste would vary with kiln design and size.

The salts of zinc or copper (I), preferably copper, are generally added to the waste in amount of at least about 1, preferably between about 1 and about 15, most preferably between about 3 and about 7 weight percent based on the weight of the waste feed. Suitable salts include, but are not limited to halides, carbonates, sulfates, acetates and phosphates of zinc or copper (I). Particularly preferred are carbonates and chloride salts of zinc or copper (I), most particularly chloride salts. Mixtures of these salts may also be employed in this invention.

The salt catalyst may be employed in this invention as (dry) particulate wherein the catalyst particle size is preferably below about 0.25 mm, more preferably below about 0.1 mm diameter. Optionally, in the case of water soluble salt catalysts, the catalyst maybe employed in an aqueous solution of a soluble salt catalyst, e.g., $ZnCl_2$, the solution can be sprayed on to the waste prior to introduction into the kiln or furnace. The water will evaporate during initial heating of the waste, leaving a finely divided film of salt crystals on the surface of the waste material to be pyrolyzed. Selection of the optimal concentration of the aqueous solution so as to apply the required amount of salt catalyst would be within the skill of one in the art. As would be apparent to one in the art, a particulate salt catalyst as well as an aqueous solution of salt catalyst, employing the same or different salt would also be suitable; for example, an aqueous solution could be employed on the waste prior to pyrolysis and particulate added during pyrolysis.

While the quartz tube and rotary systems described above can be employed in the improved process of the subject invention to pyrolyze rubber and plastic waste, they should not be construed as limiting to the improved process. Any pyrolytic system, wherein a rubber and plastic waste/salt mixture can be suitably pyrolyzed is acceptable. Selection of optimal process parameters, including those for particle size, pyrolysis temperature, process time, inert gas, and gas sweep rate, for example, would be well within the skill of those in the art.

It should be apparent that while the plastic and rubber waste converted by means of this invention were shredded wastes obtained from scrapped automobiles, any plastic and rubber waste would be advantageously converted by means of the improved process of this invention.

By including the salts of zinc or copper (I) (or suitable mixture of these salts) in rubber and plastic waste subject to pyrolysis, the potential of using a pyrolytic process for recovering valuable chemical feed stock and energy from these wastes is greatly increased.

While the invention has been shown and described in its preferred embodiment, it will be clear to those skilled in the art to which it pertains that many changes and modifications may be made thereto without departing from the scope of the invention.

INDUSTRIAL APPLICABILITY

It will be obvious from the foregoing that this invention has industrial applicability to processes for the pyrolytic conversion of rubber and plastic wastes to hydrocarbons and provides an improved process which results in reduced levels of nitrogen and sulfur impurities in the hydrocarbon products.

The invention will be further understood by referring to the following detailed examples. It should be understood that the specific examples are presented by way of illustration and not by way of limitation.

EXAMPLE 1

(a) A mixture containing 50 grams of automobile shredder waste is placed in a quartz boat and introduced into the heated zone of a tube furnace, swept with nitrogen and maintained at a temperature of 553 ±5° C. After 45 minutes at that temperature, the furnace is allowed to cool. The volatile products are condensed in a series of traps. The trapped gases are identified by Fourier transform infrared spectroscopy. Liquids obtained are analyzed by gas chromotography/mass spectroscopy, gas chromotography, gel permeation chromotography and nuclear magnetic resonance spectroscopy. Elemental analysis is conducted or the char and liquid products. The oil product obtained contained 0.81% by weight sulfur and 1.05% by weight of the sulfur and 85.4% by weight of the nirogen originally present in the waste appear in these products.

(b) 50 grams of automobile shredder waste and 2.5 grams of cuprous chloride powder (150 mesh) are combined and uniformly mixed. The experiment of Example 1 above is repeated. The product oil now contains 0.56% by weight sulfur and 0.56% by weight nitrogen. The volatile gases and liquid now contain 34% of the sulfur originally present in the waste. However, 95% of the nitrogen volatilized.

EXAMPLE 2

The catalyzed experiment of Example 1 above is repeated, except that zinc chloride is used instead of cuprous chloride powder, the liquid product now contains 0.53% nitrogen and about 0.79% sulfur by weight.

EXAMPLE 3

Cuprous acetate is used instead of cuprous chloride in Example 1 above. The liquid obtained now contains only 0.53% sulfur and 0.61% nitrogen.

EXAMPLE 4

Example 1 above repeated using zinc carbonate instead of cuprous chloride and maintaining the furnace temperature at 660±5° C. Only 20.8% of the sulfur and 27.1% of the nitrogen in the feed appears in the volatile products. The oil product contain only 0.76% sulfur and 0.51% nitrogen by weight.

EXAMPLE 5

The experiment in Example 1 is repeated, except 5 grams of cuprous chloride salt is used. The oil product now contains 0.42% by weight sulfur and 0.52% nitrogen.

In view of this disclosure, many modifications of this invention will be apparent to those skilled in the art. It is intended that all such modifications which fall within the true scope of this invention be included within the terms of the appended claims.

We claim:

1. An improvement in a process for the pyrolytic conversion of waste selected from rubber and plastic to hydrocarbon products which results in reduced levels of nitrogen and sulfur impurities in said products, the improvement comprising pyrolyzing said waste at a temperature of between about 400° C. and about 700° C. in a pyrolysis zone through which inert gas is fowing in the presence of at least about 1 weight percent, based on the weight of said waste, of zinc or copper (I) salts for a time sufficient to pyrolyze said waste to char and volatile hydrocarbon- containing products.

2. An improved process according to claim 1, wherein said salts are present in an amount of between about 1 and about 15 weight percent based on the weight of said waste.

3. An improved process according to claim 2, wherein said salts are present in an amount of between about 3 and about 7 weight percent based on the weight percent of said waste.

4. An improved process according to claim 1, wherein said salts comprise halides, carbonates, sulfates, acetates and phosphates.

5. An improved process according to claim 4, wherein said salts are selected from chloride and carbonates.

6. An improved process according to claim 1, wherein said waste is pyrolyzed in the presence of flowing inert gas which consists of a mixture of nitrogen and carbon dioxide obtained by burning a fuel gas mixture with a stoichiometric amount of air

7. An improved process according to claim 1, wherein said salts employed have a particle size below about 0.25 mm.

8. An improved process according to claim 1, wherein said salts soluble in water are employed as aqueous solutions thereof, said solution being admixed with said waste prior to pyrolysis of said waste.

9. An improved process according to claim 1, wherein at least a portion of said salts are admixed with said waste prior to pyrolysis of said waste.

10. An improved process according to claim 1 or 9, wherein at least a portion of said salts are admixed with said waste during pyrolysis of said waste.

* * * * *